US005945356A

United States Patent [19]

Pott

[11] Patent Number: 5,945,356

[45] Date of Patent: Aug. 31, 1999

[54] REINFORCING WEB AND PRODUCTION THEREOF

[76] Inventor: Richard Pott, D-32791 Lage, Lage, Germany

[21] Appl. No.: 08/729,060

[22] Filed: Oct. 10, 1996

[51] Int. Cl.[6] ..... D04H 3/00; D04H 3/12

[52] U.S. Cl. ..... 442/57; 428/116; 428/118; 442/58

[58] Field of Search ..... 156/181, 177, 156/178, 179; 442/57, 58; 428/116–118

[56] References Cited

U.S. PATENT DOCUMENTS

| | | | |
|---|---|---|---|
| 3,041,230 | 6/1962 | Diehl | 156/172 |
| 3,546,056 | 12/1970 | Thomas | 442/57 X |
| 3,629,047 | 12/1971 | Davison | 442/57 X |
| 3,638,573 | 2/1972 | Campbell . | |
| 3,723,235 | 3/1973 | Armstrong | 442/57 X |
| 3,823,049 | 7/1974 | Vetrovec . | |
| 3,837,996 | 9/1974 | Braun | 442/57 X |
| 4,302,495 | 11/1981 | Marra | 442/57 X |
| 4,507,164 | 3/1985 | Pott . | |
| 4,617,219 | 10/1986 | Schupack | 442/57 X |
| 4,647,326 | 3/1987 | Pott . | |
| 5,445,693 | 8/1995 | Vane | 156/93 |

FOREIGN PATENT DOCUMENTS

| | | |
|---|---|---|
| 313130 | 2/1974 | Australia . |
| 1 635 610 | 8/1969 | Germany . |
| 3147228 C2 | 7/1984 | Germany . |

*Primary Examiner*—Jeff H. Aftergut
*Attorney, Agent, or Firm*—Darby & Darby

[57] ABSTRACT

A reinforcing web has two elongated reinforcing layers. Each reinforcing layer consists of parallel fiber segments which are inclined to the longitudinal axis of the respective layer at an angle of 30 to 85 degrees. To make the web, adhesive with a protective covering is applied to one surface of an elongated band. The band consists of fibers which run parallel to the longitudinal axis of the band. The coated band is wound onto a take-off reel which travels along an endless track. The track is located next to a pair of supports and can rotate 90 degrees to either side of a middle position in which the track is parallel to the supports. The track is swivelled from the middle position through an angle which is a function of the desired orientations of the fiber segments. The take-off reel then begins to move along the track, and the band is deposited on the supports as the reel moves. A take-up reel which travels with the take-off reel winds up the protective covering of the adhesive. The band is held on the supports as the take-off reel travels from one support to the other to deposit one layer and then back to deposit a superposed second layer. The adhesive sides of the layers face one another, and the superposed layers are passed through pressure rollers to bond the layers and form the reinforcing web.

14 Claims, 3 Drawing Sheets

REINFORCING WEB AND PRODUCTION THEREOF

BACKGROUND OF THE INVENTION

The invention relates to a reinforcing article and production of the article.

So-called 45 degree or multiaxial webs consist of two or more layers containing respective fiber segments. The fiber segments of each layer define an angle of 45 degrees with the longitudinal axis of the respective web and an angle of 90 degrees with one another. These webs find particular utility where close manufacturing tolerances, good surface quality and high shear resistance between layers are not important. Nonetheless, due to the load-bearing ability derived from their structure, they are superior to all other types of webs, as well as to nonwoven articles, especially for the reinforcement of components subjected to torsion.

Multiaxial webs currently are produced largely by stitching. Rovings (bundles of reinforcing fibers) or lengths of yarn are laid parallel to and in contact with one another in layers, and the rovings or lengths of yarn of adjoining layers are then oriented at an angle of 45 degrees to the longitudinal axis of the web and at an angle of 90 degrees to one another. Subsequently, the layers are stitched by special machines using an expensive, troublesome and slow procedure.

These multiaxial webs have voids between the rovings or lengths of yarn. Furthermore, adjoining layers cannot be properly fixed relative to one another by stitching so that they tend to shift with respect to each other. As a result, the webs cannot be punched without being destroyed (punching of the webs is essential, for example, in the manufacture of mass produced components). Moreover, the voids absorb large amounts of laminating resin thereby leading to a reduction in strength, additional weight and greatly diminished surface smoothness. A web which is free of voids and lighttight over its entire area, as required by the exacting manufacturers in high technology fields, cannot be produced by stitching. The drawbacks of webs made in this manner greatly affect the economics of the webs.

Various other methods of making webs from fibers are known. In most of these methods, discrete fibers are impregnated with a laminating resin before conversion into a web. For instance, U.S. Pat. No. 3,823,049 discloses a web containing an adhesively bound fiber network in which the fibers are not oriented at 45 degrees to an axis of the web. The Austrian patent no. 313 130 teaches a winding procedure in which individual fibers impregnated with laminating resin are wound at different angles around a core consisting of a fiber mat or staple fibers. The German publication no. 31 47 228 C2 describes a multilayered body extending along the Z-axis, that is, along a vertical axis. The body, which is produced by stitching, constitutes a rotor head for a helicopter. The body contains fibers which are inclined at 45 degrees to the Z-axis, i.e., are inclined at 45 degrees to an axis in a vertical plane rather than in a horizontal plane. The German publication no. 16 35 610 discloses a web containing a fiber network made from discrete fibers.

SUMMARY OF THE INVENTION

It is an object of the invention to provide a fibrous article which can be made with a high degree of precision.

Another object of the invention is to provide a fibrous article which can be produced efficiently.

An additional object of the invention is to provide a method which allows a fibrous article to be manufactured to close tolerances.

A further object of the invention is to provide a method which enables a fibrous article to be made with a high degree of efficiency.

It is also an object of the invention to provide an apparatus which permits a fibrous article to be produced with a high degree of precision.

Yet another object of the invention is to provide an apparatus which makes it possible to manufacture a fibrous article efficiently.

The preceding objects, as well as others which will become apparent as the description proceeds, are achieved by the invention.

One aspect of the invention resides in a fibrous article, e.g., a fibrous reinforcing web. The article comprises a first layer having a first axis and a plurality of generally parallel first fiber segments, and a second layer having a second axis generally parallel to the first axis and a plurality of generally parallel second fiber segments. The first fiber segments define a first angle different from 0 degrees with the axes, the second fiber segments define a second angle different from 0 degrees with the axes, and the first and second fiber segments also define a third angle different from 0 degrees with one another. The article further comprises a bonding layer between the first and second layers. The bonding layer preferably includes an adhesive.

The first and second layers, which may be integral, can be pressure bonded to each other. The first and second fiber segments advantageously define an angle of about 60 degrees to about 170 degrees with one another.

Due to the bonding layer, neither woof threads nor stitches are required in order to establish a connection between the first and second layers. Since woof threads and stitches function to reduce strength and produce uneven surfaces with voids, elimination of these elements makes it possible to create an inherently stable, punchable article in which the layers essentially do not shift. Modern adhesives can be closely matched to the material or materials of the article so as not to degrade the physical properties of the article. Processing can be carried out reliably and in accordance with current adhesive bonding practice.

Another aspect of the invention resides in a method of making a fibrous article. The method comprises the step of forming a first layer having a plurality of generally parallel first fiber segments and a second layer having a plurality of generally parallel second fiber segments. The first layer has a first axis and the second layer has a second axis generally parallel to the first axis. The forming step is performed such that the first segments define a first angle different from 0 degrees with the axes, the second segments define a second angle different from 0 degrees with the axes, and the first and second segments define a third angle different from 0 degrees with one another. The method further comprises the step of bonding the first and second layers to one another by way of a bonding layer.

The forming step may include providing an array of generally parallel fibers which include the first fiber segments and the second fiber segments, and rotating the first fiber segments relative to second fiber segments. The forming step can also involve folding the array to overlap the first and second fiber segments.

The bonding step may comprise urging the first and second layers towards one another.

A further aspect of the invention resides in an apparatus for making a fibrous article. The apparatus comprises a source of fibers, and operating means for withdrawing the fibers from the source, layering the fibers and rotating the source.

Additional features and advantages of the invention will be forthcoming from the following detailed description of preferred embodiments when read in conjunction with the accompanying drawings.

DESCRIPTION OF THE PREFERRED EMBODIMENTS

Figure 1:
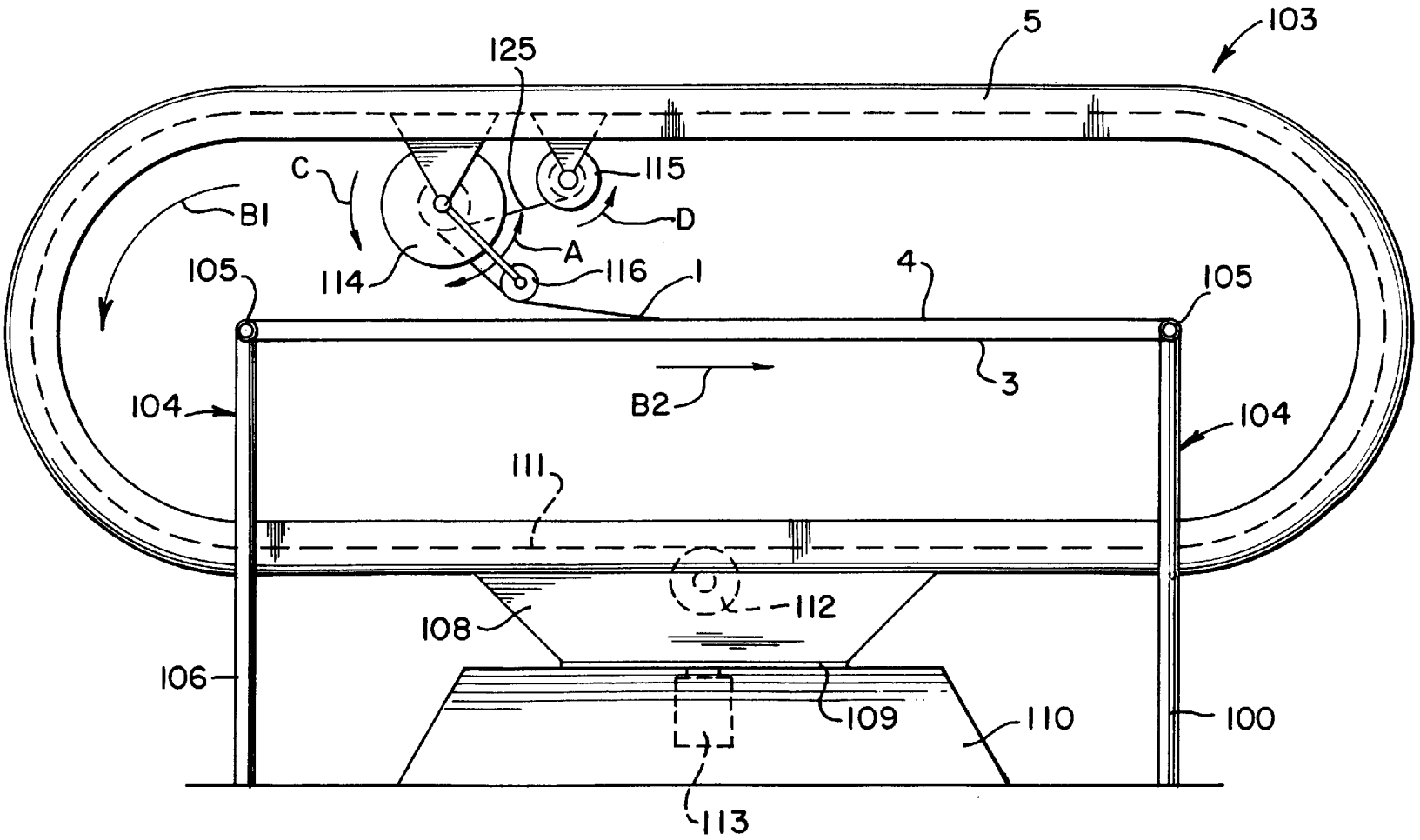
FIG. 1 is a schematic side view illustrating certain components of an apparatus in accordance with the invention for producing reinforcing articles.
Figure 2:
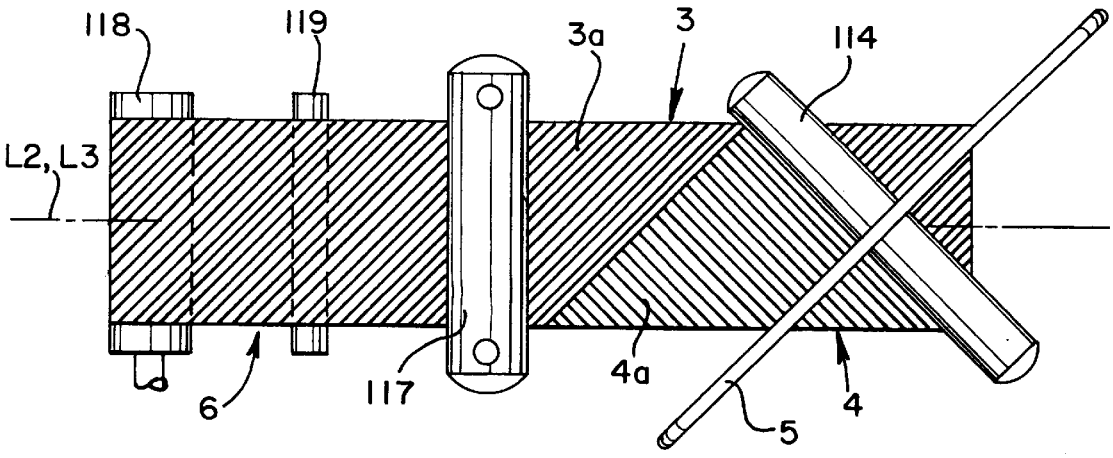
FIG. 2 is a schematic plan view showing additional components of the apparatus.

FIGS. 1 and 2 show an apparatus 103 in accordance with the invention for making a fibrous reinforcing web or band per the invention. The apparatus 103 includes a pair of spaced supporting units 104 which are movable towards and away from one another. The supporting units 104 comprise vertical posts or columns 106 which are provided with holding or carrying members 105 at the upper ends thereof.

Between the supporting units 104 is a pedestal or foundation 110 which carries a turntable 108. The turntable 108 is supported by a rotary member which is mounted on the pedestal 110 and is preferably spherical. A drive 113 serves to rotate the turntable 108 on a vertical axis.

The turntable 108 supports a generally oval track or guide 5 which defines an endless path and is hollow in cross section. In the illustrated embodiment, the track 5 has a U-shaped cross section. An endless chain or transporting member 111, such as a roller chain, is located inside and runs around the track 5. The chain 111 is driven by a drive 112.

Stops are provided to limit rotation of the turntable 108 both clockwise and counterclockwise. The stops are adjustable and permit the turntable 108 to rotate through an angle of 180 degrees maximum. The stops are arranged so that the frame 5 is parallel to the posts 106 when the frame 5 coincides with the bisector of the angle defined by the stops. The turntable 108 and frame 5 are therefore rotatable both clockwise and counterclockwise from the position in which the frame 5 parallels the posts 106.

A braked take-off reel or roller 114 is connected to the chain 111. The take-off reel 114 constitutes a supply source for an array of generally parallel elongated flexible elements in the form of an elongated band or strip 1 which is wound onto the take-off reel 114. The flexible elements are here reinforcing fibers which are arranged in bundles. A depositing or laying roller 116 is pivotally suspended from the take-off reel 114 as indicated by the double-headed arrow A. The depositing roller 116 has a length equal or approximately equal to that of the take-off reel 114 and serves to uniformly deposit the band 1 on the holding members 105. In order to maintain a constant tension in the band 1 during deposition, the take-off reel 114 is provided with a conventional, non-illustrated device for measuring the overall diameter of the combined take-off reel 114 and band 1 as the band 1 is unwound from the take-off reel 114.

The band 1 is deposited in a predetermined path and, at any location of the path, the depositing roller 116 is maintained very precisely at a predetermined distance therefrom. This is accomplished electronically via conventional, non-illustrated sensors. The sensors can, for example, be ultrasonic.

Also connected to the chain 11 is a take-up reel or roller 115. As will be explained in greater detail below, one major surface of the band 1 is provided with an adhesive layer. The adhesive layer, in turn, is covered with an anti-adhesive protective foil 125 which prevents the adhesive layer from sticking to the opposite major surface of the band 1 when the band 1 is coiled onto the take-off reel 114. The take-up reel 115 draws the protective foil 125 from the band 1 under constant tension during deposition of the band 1 on the holding members 105. The take-up reel 115 can be disposed at in front of or behind the take-off reel 114 at a predetermined distance therefrom. It is likewise possible to locate the take-up reel 115 to either side of, and at a selected distance from, the take-off reel 114.

The take-off reel 114 has a horizontal longitudinal axis on which the reel 114 rotates during unwinding of the band 1 whereas the take-up reel 115 has a horizontal longitudinal axis on which the reel 115 rotates while coiling the protective foil 125. Similarly, the depositing roller 116 has a horizontal longitudinal axis on which the roller 116 rotates during deposition of the band 1 on the holding members 105. In addition, the take-off reel 114, take-up reel 115 and depositing roller 116 are rotatable together with the turntable 8 and track 5 about respective vertical axes.

The apparatus 103 further includes a pair of pressure rollers 117 which can be moved towards and away from one another either hydraulically or pneumatically. As will be explained more fully later, the band 1 is deposited on the holding members 105 in such a manner as to form two superimposed layers 3 and 4 which are arranged so that the adhesive sides of the layers 3,4 face each other. The pressure rollers 117 function to compress the layers 3,4 thereby firmly bonding the layers 3,4 to one another and smoothing the outer surfaces thereof. This yields a reinforcing web or band 6 in which the layers 3,4 are fixed and do not shift relative to each other. The pressure rollers 117 can, for instance, form part of a driven calendering unit.

The apparatus 103 additionally includes a take-up reel or roller 118 for the web 6. The take-up reel 118 is driven and constitutes a main drive which determines the operating speed of the apparatus 103. Winding of the web 6 onto the take-up reel 118 is electronically controlled.

Between the pressure rollers 117 and the take-up reel 118 is a braked supply reel or roller 119. The supply reel 119 carries a finishing foil which is used to cover one major surface of the web 6 before the web 6 is wound onto the take-up reel 118. The finishing foil preserves the surface smoothness of the web 6 by forming a barrier between adjacent surface portions of the web 6 as the latter is coiled on the take-up reel 118. Such a barrier prevents adjacent surface portions of the web 6 from contacting one another and thus prevents fibers at one surface portion from catching on fibers at an adjacent surface portion.

Figure 3:
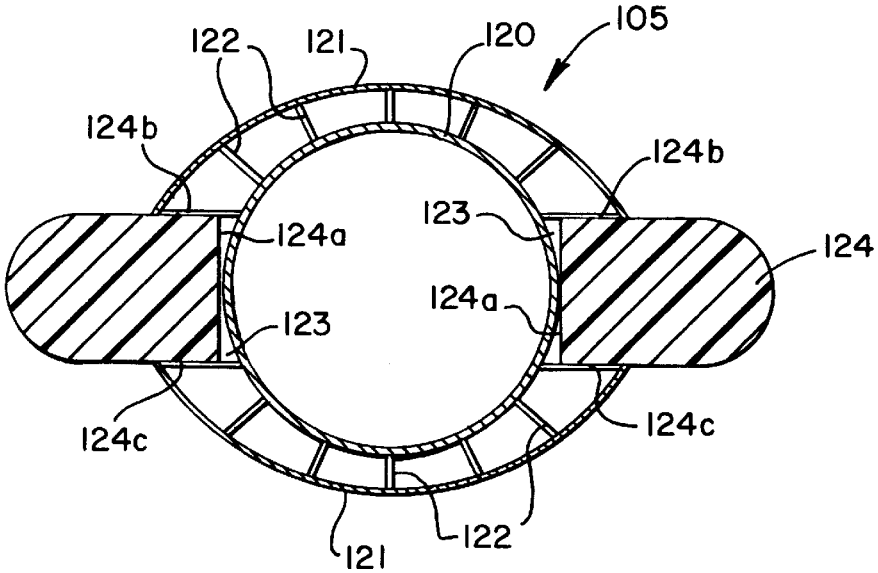
FIG. 3 is an enlarged transverse sectional view of one of the components of the apparatus.

FIG. 3 shows one embodiment of the holding members 105. The illustrated holding member 105 comprises a cylindrical carrier tube 120. A pair of part-oval or part-elliptical shells 121 are mounted on the tube 120 externally thereof by way of connectors 122, e.g., straps. The shells 121 are symmetrically arranged with respect to one another and cooperate to define two gaps 123 extending lengthwise of the tube 120. The gaps 123 are disposed diametrically opposite each other, and an endless conveying or transporting belt 124 passes through the gaps 123. The belt 124 is mounted on non-illustrated pulleys which allow the tension in the belt 124 to be adjusted.

The external peripheral surface portions of the shells 121 and the belt 124 are anti-adhesive. To this ends, the shells 121 may be provided with an anti-adhesive coating such as, for example, hard chrome, silicone or polytetrafluoroethylene. The belt 124 can be made of silicone rubber.

The belt 124 has a surface 124*a* which faces the tube 120, and two surface portions 124*b* and 124*c* which face the respective shells 121. The surface 124*a* and surface portions 124*b*,124*c* are provided with antifriction coatings which are preferably also anti-adhesive.

The belt 124 serves to transport the superimposed layers 3,4 of the band 1 to the pressure rollers 117.

The embodiment of FIG. 3 represents only one of several conceivable structures for the holding members 105. Thus, by way of example, the holding members 105 can be in the form of cylindrical bodies which resemble or constitute rollers. Furthermore, when conveying belts such as the illustrated belt 124 are employed, the posts 106 may be eliminated.

Considering FIG. 4 in conjunction with FIGS. 1–3, the web 6 is made as follows:

The band 1 is produced in a conventional manner and in a length matched to the desired length of the finished web 6. The band 1 has a longitudinal axis L1 and includes an array of elongated flexible elements la which run parallel thereto. In the illustrated embodiment, the flexible elements are in the form of reinforcing fibers which have been combined into bundles.

An adhesive layer 2 is bonded to one major surface of the band 1, e.g., by calendering. The adhesive layer 2, which is not cured and still moist, here consists of intersecting fibers or fiber segments 2*a* and 2*b* which form a mesh or grid and are coated or impregnated with an adhesive. The adhesive layer 2 has a major surface which faces away from the band 1, and this major surface is covered with the anti-adhesive protective foil 125.

The take-off reel 114 is positioned adjacent one of the holding members 105. In the present case, it is assumed that the take-off reel 114 is positioned on the upper run of the track 5 and in the region of the right-hand holding member 105 in FIG. 1. The band 1 with the adhesive layer 2 and protective foil 125 is wound onto the reel 114 in such a manner that, upon unwinding, the adhesive layer 2 faces the holding members 105.

The distance between the supporting units 104 is adjusted so as to match the desired length of the finished web 6. Furthermore, the depositing roller 116 is positioned at a predetermined distance from the path in which the band 1 is to be laid.

The stops for the turntable 108 are set so as to allow the track 5 to rotate 30 to 85 degrees to either side of its middle position, that is, the position in which the track 5 is parallel to the posts 106. The drive 113 is activated to swing the turntable 108 against one of the stops, and it is here assumed that the turntable 108 and the track 5 swivel counterclockwise. The take-off reel 114, take-up reel 115 and depositing roller 116 rotate with the track 5 about respective vertical axes.

The drive 112 is started and, in the showing of FIG. 1, advances the chain 111 counterclockwise as indicated by the arrows B1 and B2. The take-off reel 114, take-up reel 115 and depositing roller 116 accordingly begin to move counterclockwise along the track 5. As the take-off reel 114, take-up reel 115 and depositing roller 116 move, the band 1 with the adhesive layer 2 and protective foil 125 is progressively unwound from the take-off reel 114 per the arrow C. The protective foil 125 is progressively peeled from the adhesive layer 2 and coiled onto the take-up reel 115 as denoted by the arrow D. Coiling of the protective foil 125 onto the take-up reel 115 takes place under constant tension.

The depositing roller 116 urges the band 1 downward as the band 1 unwinds from the take-off reel 114. Starting from the right-hand holding member 105, the band 1 is uniformly deposited in an upper horizontal segment of an endless path to form a layer 4 which carries the adhesive layer 2 on the underside thereof. At each location of the endless path, which runs around the holding members 105, the depositing roller 116 is maintained at a predetermined distance from the path by sensing the last increment of the band 1 to have been deposited. As seen in FIGS. 2 and 4, the layer 4 contains a series of generally parallel fiber bundle segments 4*a* which constitute segments of the fiber bundles 1*a* of the band 1. The layer 4 has a longitudinal axis L2, and the arrangement is such that the fiber bundle segments 4*a* define an angle of 30 to 85 degrees, and advantageously 45 degrees, with the axis L2. The angle between the fiber bundle segments 4*a* and the longitudinal axis L2 is a function of the angle by which the track 5 is rotated from its middle position while the layer 4 is being formed.

At the end of the track 5 remote from the right-hand holding member 105, the track 5 guides the take-off reel 114 through a 180 degree turn to the lower run of the track 5. As the take-off reel 114 passes through the turn, the segments of the fiber bundles 1*a* being deposited in the path of the band 1 undergo a change in orientation relative to the fiber bundle segments 4*a*.

The band 1 is passed around the left-hand holding member 105 during travel of the take-off reel 114 through the turn at the left-hand end of the track 5. Consequently, the band 1 is bent or folded. As the take-off reel 114 moves away from the left-hand holding member 105, the depositing roller 116 urges the band 1 uniformly into a lower horizontal segment of the path around the holding members 105 to form a layer 3 which carries the adhesive layer 2 on the upper side thereof. The layer 3 is generally parallel to, and superposed with, the layer 4. As shown in FIGS. 2 and 4, the layer 3 contains a series of generally parallel fiber bundle segments 3*a* which constitute segments of the fiber bundles 1*a* of the band 1. The layer 3 has a longitudinal axis L3 which is parallel to and superposed with the longitudinal axis L2 of the layer 4, and the arrangement is such that the fiber bundle segments 3*a* define an angle of 30 to 85 degrees, and advantageously 45 degrees, with the axis L3. The angle between the fiber bundle segments 3*a* and the longitudinal axis L3 is a function of the angle by which the track 5 is rotated from its middle position while the layer 3 is being formed.

The fiber bundle segments 3*a* extend transversely of the fiber bundle segments 4*a*. Since the track 5 is rotated 30 to 85 degrees from its middle position during formation of the layers 3,4, the fiber bundle segments 3*a* and fiber bundle segments 4*a* define an angle of 60 to 170 degrees, and favorably an angle of 90 degrees, with one another.

When the take-off reel 114 reaches the right-hand end of the track 5, deposition of the band 1 is completed. The belts 124 are started and transport the superposed layers 3,4, which adhere to each other loosely if at all, to the pressure rollers 117. The pressure rollers 117, which are located as close as possible to the path in which the band 1 is deposited, exert a compressive force on the layers 3,4 and the intervening adhesive layers 2. The layers 3,4 are urged towards one another and firmly bonded to yield the reinforcing web 6. The web 6 is conveyed to the supply reel 119, where one major surface thereof is covered with the finishing foil, and subsequently wound onto the take-up reel 118 under electronic control.

The web 6 is a multiaxial web. If the fiber bundle segments 3*a* and 4*a* define angles of 45 degrees with the respective longitudinal axes L2 and L3, and an angle of 90 degrees with one another, the web 6 can also be referred to as a 45 degree web.

The multiaxial web 6 is a semifinished product of high quality having smooth surfaces which are generally free of voids that can reduce strength. The fiber bundle segments 3*a* of the layer 3 lie against one another as do the fiber bundle segments 4*a* of the layer 4. The finishing foil applied to the web 6 by the supply reel 119 prevents contact between confronting surface portions of the web 6 when the latter is wound onto the take-up reel 118. The finishing foil accordingly helps to preserve the smooth surface finish of the web 6 and to prevent fibers at one surface portion from catching on fibers at an adjoining surface portion.

Figure 4:
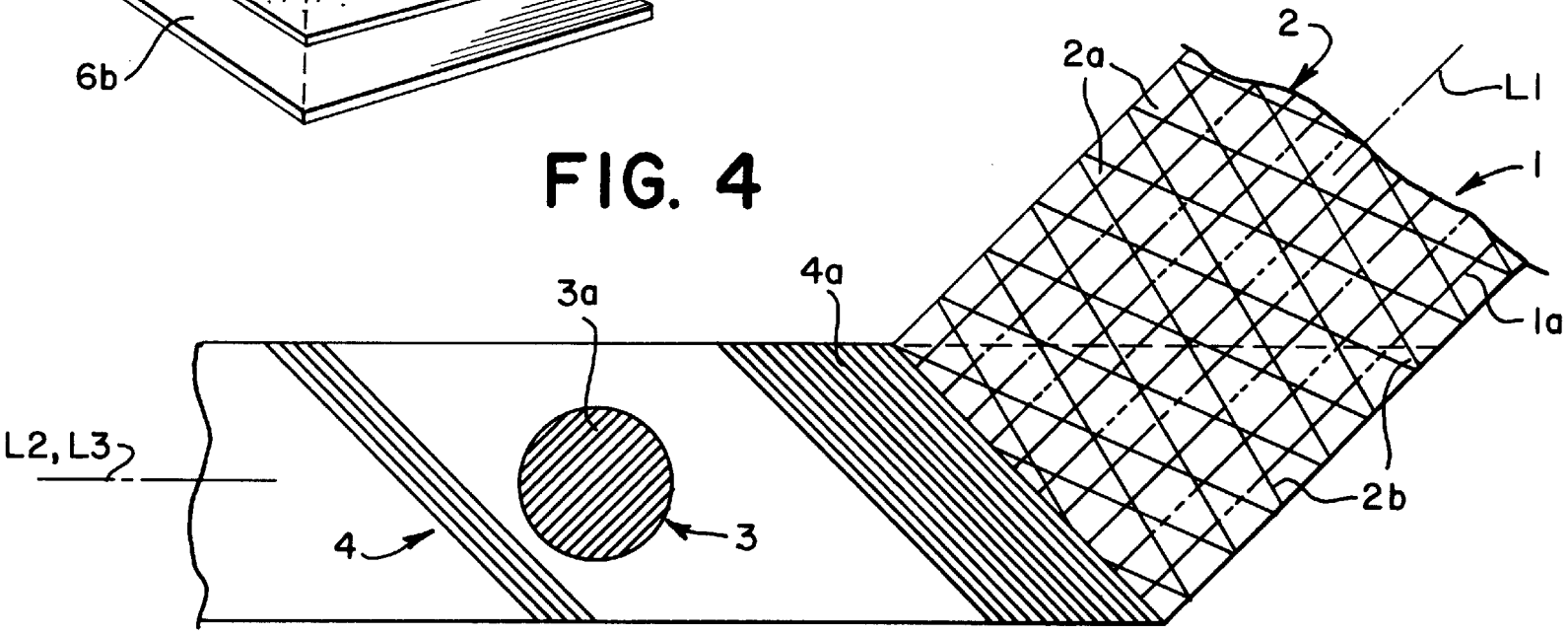
FIG. 4 is a fragmentary plan view illustrating steps in the production of a reinforcing article with the apparatus of FIGS. 1 and 2.

FIG. 4 shows that the layer 4 is generated by rotating or bending first segments of the fiber bundles 1*a* of the band 1 relative to second segments of the fiber bundles 1*a*. The first segments then form the fiber bundle segments 4*a*. The layer 3 is subsequently generated by rotating or bending the fiber bundle segments 3*a*, which likewise constitute part of the fiber bundles 1*a*, relative to the fiber bundle segments 4*a*.

The web 6 is produced using a procedure which involves rotation, winding and deposition. By maintaining the depositing roller 116 at a precise distance from the path of the band 1 at each location of the path, the layers 3,4 are deposited under the same tension and gaps between the layers 3,4 can be essentially avoided. Moreover, the layers 3,4 are deposited with their edges exactly or very nearly in register so that the web 6 has a smooth exterior free of steps caused by misaligned edges. In addition, precise positioning of the depositing roller 116 enables unevennesses in the layers 3,4 to be substantially eliminated.

The layers 3,4 of the web 6 are integral. The pressure rollers 117 cause the layers 3,4 to be bonded so tightly that the layers 3,4 essentially cannot shift relative to each other.

Rotation of the turntable 108 as a function of the angular orientations of the fiber bundle segments 3*a*,4*a*, together with the electronic control of the take-up reel 118 for the finished multiaxial web 6, allows production of the web 6 to proceed in a continuous and highly synchronous fashion. Since the apparatus 103 for making the web 6 can be designed so that all drives and driven components operate in synchronism, production routines and output can be largely established in advance.

Figure 5:
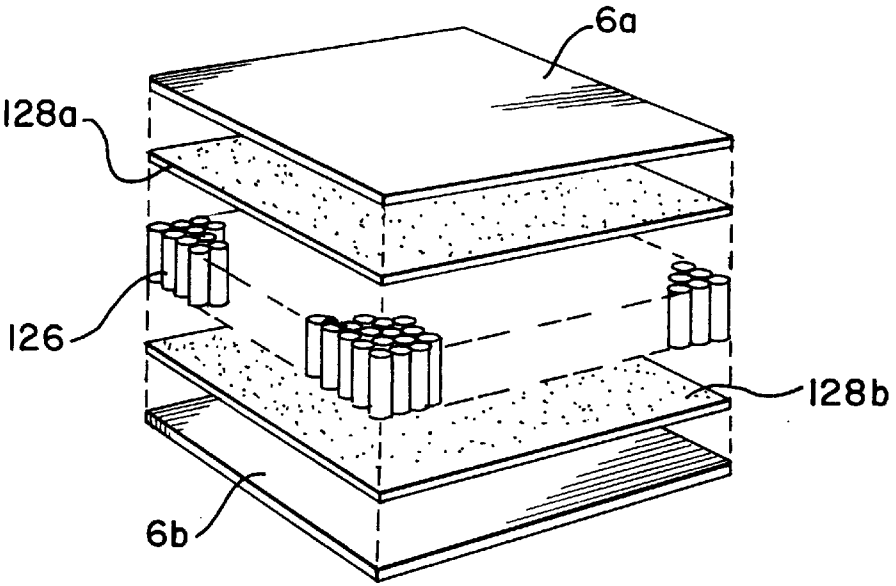
FIG. 5 is an exploded perspective view of a composite incorporating portions of articles according to the invention.

FIG. 5 illustrates one manner of using the web 6. Here, two portions 6*a* and 6*b* of the web 6 are combined with a honeycomb sheet 126 to form a composite reinforced article 127. The two web portions 6*a*,6*b* are respectively bonded to the two major surfaces of the honeycomb sheet 126 by way of adhesive layers 128*a* and 128*b*. It is also possible to laminate the honeycomb sheet 126 to the web portions 6*a*,6*b*.

The honeycomb sheet 126 represents but one of many products which can be bonded to the web 6 or the web portions 6*a*,6*b*. Other products include plywood and sheet metal.

The reinforcing fiber bundles 1*a* of the band 1, and hence the the fiber bundle segments 3*a*,4*a* of the layers 3,4, can be made of various materials. For instance, the reinforcing fibers may be composed of glass, carbon, silicon carbide, hemp, flax, sisal, coconut, aromatic polyamide, polyester and polyethylene. The reinforcing fibers can further consist of hemp, flax, sisal, coconut and other renewable substances.

The adhesive layer 2 preferably comprises fibers or fiber segments, such as the fibers or fiber segments 2*a*,2*b*, which crisscross to form a mesh or grid. However, the adhesive layer 2 may take other forms. For instance, the adhesive layer 2 may include an array of fibers or fiber segments which do not define a mesh or grid and extend transversely of the band 1 in parallelism with one another. It is further possible for the adhesive layer 2 to be constituted by an adhesive film.

The adhesive layer 2 is advantageously very thin. By way of example, fibers or fiber segments used for the adhesive layer 2 can have a diameter of approximately 80 dtex.

Fibers or fiber segments incorporated in the adhesive layer 2 can consist of a variety of materials. For instance, the fibers or fiber segments for the adhesive layer 2 may be made of glass, carbon, cellulose, viscose rayon, aromatic polyamide, polyester and polyethylene.

The adhesive for the adhesive layer 2 may be a permanent adhesive or a hardenable synthetic resin. The term "permanent adhesive" is intended to denote a durable adhesive which retains its bonding ability even after being stored, or being exposed to oxygen under normal atmospheric conditions, for extended periods of time. Permanent adhesives for the adhesive layer 2 can be substances based on acrylates and dispersions. On the other hand, hardenable synthetic resins for the adhesive layer 2 include products based on epoxides, phenols and polyurethanes. Such products, which are used as matrix resins for composites, are capable of reacting with the laminating resins which may be employed during the manufacture of reinforcing articles with the web 6.

Examples of adhesives which may be used in the adhesive layer 2 are hotmelt, polyvinyl alcohol, butadiene-styrene, polyvinyl acetate and polyvinyl chloride.

The multiaxial web 6 according to the invention allows a high degree of precision and efficiency to be achieved. The web 6 can be used in an expanded range of products, e.g., mass-produced automobile components, to yield lighter and stronger structures.

The web 6 is superior to other types of webs and, in lightweight structures such as, for example, honeycomb sandwiches, enables very high torsional, tensional, compressive, impact and bending strengths to be obtained. Resin absorption, which increases weight and decreases strength, is greatly reduced with the web 6 because the voids which take up resin are virtually eliminated.

Due to the adhesive layer 2, neither woof threads nor stitches are required in order to establish a connection between the layers 3,4 of the web 6. Since woof threads and stitches function to reduce strength and produce uneven surfaces with voids, elimination of these elements makes it possible for the web to constitute an inherently stable, punchable article in which the layers 3,4 essentially do not shift. Modern adhesives can be closely matched to the material or materials of the web 6 so as not to degrade the physical properties thereof. Processing can be carried out reliably and in accordance with current adhesive bonding practice.

During the rotation, winding and deposition accompanying the production of the web 6, there is a reduction of one-third from the original width and original length of the band 1. The finished multiaxial web 6, in which the fiber bundle segments 3*a*,4*a* define an angle of 30 to 85 degrees with the longitudinal axes L2,L3 of the respective layers 3,4 and an angle of 60 to 170 degrees with one another, makes full use of the physical capabilities of the fibers of the band 1. The angles defined by the fiber bundle segments 3*a*,4*a* are selected in dependence upon the intended application of the web 6.

The web 6 may be combined with one or more other multiaxial webs. For instance, the web 6 can be combined with a multiaxial web made of a different material in order to take advantage of the characteristics of a composite containing different types of fibers. Furthermore, the web 6 may be calendered to one or more mats, woven members, adhesive films, honeycombs and uniaxial bands such as the band 1, as well as one or more other multiaxial webs, which are to serve as carriers for the web 6.

Two or more multiaxial webs according to the invention, but with different orientations of the fiber bundle segments, can be connected to thereby very nearly attain the ideal of isotropy desired by many users of reinforcing webs. Such a composite of multiaxial webs can be stressed to the same degree in virtually all directions and can fully utilize all of the physical properties of prestressed unidirectional fibers.

The following are some exemplary applications for the web 6 of the invention: hulls, armor and superstructures for boats and ships; wing skins, wheel well covers and fuselage skins for airplanes, and fuselage skins for helicopters; bodies for buses and commercial vehicles, and driver compartments for commercial vehicles; hoods, roofs, doors, integrated side impact barriers and other structural components for passenger vehicles; highly torsion-resistant outer skins for the rotor blades of helicopters and wind-powered installations; general construction of sports equipment, e.g., skis and snowboards; facings for sandwich structures; trusses and columns for external plants; and torsion-resistant and lightweight general engineering components.

The invention enables a cascade effect to be obtained for motor vehicles. Thus, the multiaxial web 6 of the invention makes it possible to reduce motor vehicle weight thereby increasing the load capacity and reducing fuel consumption. This, in turn, leads to greater economy.

The invention provides a real contribution towards the solution of the ecological and economic problems of our time.

Various modifications are possible within the meaning and range of equivalence of the appended claims.

I claim:

1. A non-woven dual layer web article, comprising:

a binder layer of adhesive material having thereon a plurality of spaced generally parallel fibers, said binder layer folded with respect to its longitudinal axis to have continuous, alternating first and second segments of said binder layer folded at an angle to the binder layer longitudinal axis to form a first longitudinal edge of the web and then refolded at an angle to the binder layer longitudinal axis to form the web second longitudinal edge, said first segments of said binder layer forming a first layer of said web having a plurality of said parallel fibers and said second segments forming a second layer of said web having a plurality of said parallel fibers, and second segments overlying said first segments, said fibers of said first segments defining a first angle different from 0 degrees from said binder layer longitudinal axis, said fibers of said second segments defining a second angle different from 0 degrees from said binder layer longitudinal axis and the overlying fiber of said first and second segments defining a third angle different from 0 degrees from said web binder layer longitudinal axis; and said first and second segments being adhesively bonded by pressure to form the dual layers of said web.

2. The web of claim 1, wherein said third angle is between about 60 degrees and about 170 degrees.

3. The web of claim 3, wherein said third angle is substantially 90 degrees.

4. The web of claim 1, wherein each of said first and second layers bonded surfaces are generally free of voids.

5. The web of claim 1 wherein said binder layer adhesive is a permanent adhesive.

6. The web of claim 1, wherein said adhesive comprises a hardenable synthetic resin.

7. The web of claim 1, wherein said fibers of said binder layer comprise a material selected from the group consisting of glass, carbon, cellulose, viscose rayon, aromatic polyamide, polyester and polyethylene.

8. The web of claim 1, wherein said fibers of said binder layer define a grid with sets of parallel fibers lying in generally transverse directions.

9. The web of claim 1, wherein the fibers of said bonding layer comprise a material selected from the group consisting of glass, carbon, silicon carbide, aromatic polyamide, polyester, polyethylene, hemp, flax, sisal and coconut.

10. The web of claim 1, wherein each of said first and second layers has a surface facing away from the surface on which they are bonded; and further comprising a honeycomb on at least one of said facing away surfaces.

11. The web of claim 10, wherein said honeycomb is laminated to said at least one facing away surface.

12. The web of claim 10, wherein said honeycomb is adhesively secured to said one facing away surface.

13. The web of claim 1, wherein said first and second layers are integral.

14. A non-woven dual web article as in claim 1 wherein said first, second and third segments are different from each other.

* * * * *